US008196223B2

(12) United States Patent
Hamilton et al.

(10) Patent No.: US 8,196,223 B2
(45) **Date of Patent: *Jun. 12, 2012**

(54) PATIENT GOWN

(75) Inventors: Linda A. Hamilton, Walbridge, OH (US); Rita K. Nye, Maumee, OH (US); Charlotte S. Steinman, Toledo, OH (US)

(73) Assignee: Patient Gowns By Design, LLC, Walbridge, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/218,687

(22) Filed: Aug. 26, 2011

(65) Prior Publication Data

US 2011/0302691 A1 Dec. 15, 2011

Related U.S. Application Data

(63) Continuation of application No. 12/368,042, filed on Feb. 9, 2009, now Pat. No. 8,028,346.

(60) Provisional application No. 61/026,879, filed on Feb. 7, 2008.

(51) Int. Cl.
*A41D 13/12* (2006.01)

(52) U.S. Cl. ..... 2/114; 2/104

(58) Field of Classification Search ..... 2/114, 115, 2/113, 104, 106, 107, 103, 119, 75, 105, 2/95, 83, 48, 52, 69, 73, 74, 78.4, 80, 109, 2/110, 112, 92, 111, 120–122

See application file for complete search history.

(56) References Cited

U.S. PATENT DOCUMENTS

| | | | | |
|---|---|---|---|---|
| 259,422 | A | 6/1882 | Philbrook | |
| 289,236 | A | 11/1883 | Dodge et al. | |
| 340,356 | A * | 4/1886 | Randolph | 2/103 |
| 399,436 | A | 3/1889 | Reinhard | |
| 622,010 | A | 3/1899 | Lowe | |
| 639,440 | A | 12/1899 | Rutenberg | |
| 642,912 | A | 2/1900 | Lowe | |
| 685,994 | A | 11/1901 | Levitas et al. | |
| 715,248 | A | 12/1902 | Davis | |
| 1,128,168 | A | 2/1915 | Marous | |
| 1,254,043 | A | 1/1918 | James | |
| 1,271,047 | A | 7/1918 | McQuarrie | |
| 1,361,155 | A | 12/1920 | Jackson | |
| 1,361,892 | A | 12/1920 | Naterman | |
| 1,906,912 | A * | 5/1933 | Lockwood | 2/115 |
| 1,915,597 | A | 6/1933 | Ducker | |
| 2,301,527 | A | 11/1942 | English et al. | |
| 2,638,598 | A | 5/1953 | Reuben | |
| 3,116,491 | A | 1/1964 | Previdi et al. | |
| 4,031,566 | A | 6/1977 | Johnson | |
| 4,208,743 | A | 6/1980 | Whitcraft | |
| 4,458,365 | A | 7/1984 | Wood | |
| 4,797,954 | A | 1/1989 | Williams et al. | |

(Continued)

*Primary Examiner* — Amy B. Vanatta

(74) *Attorney, Agent, or Firm* — Fraser Clemens Martin & Miller LLC; Jacob M. Ward

(57) ABSTRACT

A patient gown for a nursing mother is disclosed, the patient gown includes an outer gown releasably fastened in a front thereof, an upper portion of said outer gown having shoulder straps cooperating to form the upper opening, wherein a front of the shoulder straps is fastened to a back of the shoulder straps, and an inner jacket fastened to an interior of the outer gown. The outer gown and inner jacket cooperate to provide coverage of a desired portion of the body of the patient, as well as coverage of a nursing child, as desired.

9 Claims, 5 Drawing Sheets

U.S. PATENT DOCUMENTS

| | | | |
|---|---|---|---|
| 4,920,578 | A | 5/1990 | Janzen et al. |
| 4,964,173 | A | 10/1990 | Gordon et al. |
| 4,995,116 | A | 2/1991 | Beauchamp et al. |
| 5,611,086 | A | 3/1997 | Eggen |
| 5,946,726 | A | 9/1999 | Green |
| 6,032,288 | A | 3/2000 | Simone |
| 6,032,289 | A | 3/2000 | Villapiano |
| 7,181,773 | B1 | 2/2007 | Piraka |
| 2007/0240248 | A1 | 10/2007 | Hodges et al. |
| 2011/0016606 | A1 | 1/2011 | Bothwell |

* cited by examiner

PATIENT GOWN

CROSS-REFERENCE TO RELATED APPLICATION

This is a continuation application of U.S. patent application Ser. No. 12/368,042, filed on Feb. 9, 2009 hereby incorporated herein by reference, which claims the benefit of U.S. Provisional Patent Application Ser. No. 61/026,879, filed on Feb. 7, 2008 hereby incorporated herein by reference.

FIELD OF THE INVENTION

The invention relates to a patient gown, and more particularly to an improved nursing gown for use by a nursing mother.

BACKGROUND OF THE INVENTION

Hospital gowns, as well as other garments that may be used by nursing mothers, have been known for many years. Hospital gowns are typically formed from a unitary piece of material that is releasably fastened in the back. The gown may be opened to facilitate access to the patient for various medical procedures, observation, and the like. Since the gown opens in the back, the patient's backside may be exposed and the use of a robe, an undergarment, or other similar covering may be required for adequate coverage of the patient.

One problem with typical gowns is that a nursing mother may desire privacy during nursing of a child. Some designs, such as that disclosed in U.S. Pat. No. 5,182,813 to Booze, may incorporate apertures formed in a gown that are covered when a child is not nursing by pleats formed therein. However, such pleats may open to reveal the breast and may not provide adequate coverage of the nursing mother. Other gowns known in the art open in the front of the patient and facilitate the exposure of the breast for nursing. Such gowns require the entire chest and abdomen of a nursing mother to be revealed and do not provide adequate privacy. Further, the nursing child is also exposed during nursing.

It would be desirable to develop a patient gown having an outer gown releasably fastened in a front thereof and providing an inner jacket releasably fastened to an interior of the outer gown, the outer gown and inner jacket cooperating to provide adequate coverage of the patient, as well as coverage of a child, during nursing.

SUMMARY OF THE INVENTION

Concordant and congruous with the present invention, a patient gown having an outer gown releasably fastened in a front thereof and providing an inner jacket releasably fastened to an interior of the outer gown, the outer gown and inner jacket cooperating to provide adequate coverage of the patient, as well as coverage of a child, during nursing has been surprisingly discovered.

In an embodiment of the invention, a patient gown comprises an outer gown having a body portion with arm openings and an upper opening and a first means for fastening for selectively closing a front thereof, an upper portion of said outer gown having shoulder straps cooperating to form the upper opening, wherein a front of the shoulder straps is releasably fastened to a back of the shoulder straps; an inner jacket including a second means for fastening for selectively closing a front thereof, said inner jacket fastened to said outer gown to cooperate therewith to form an upper opening, wherein said inner jacket is adapted to cover a desired portion of the patient.

In another embodiment of the invention, a patient gown comprises an outer gown having a body portion with arm openings and an upper opening and a first means for fastening for selectively closing a front thereof; an inner jacket including a second means for fastening for selectively closing a front thereof, said inner jacket releasably fastened to said outer gown, to cooperate therewith to form an upper portion, wherein said inner jacket is adapted to cover a desired portion of the patient; and a third means for releasably fastening said inner jacket to said outer gown.

In another embodiment of the invention, the patient gown comprises an outer gown having a body portion with arm openings and an upper opening, and a first means for fastening for selectively closing a front thereof; an inner jacket including a second means for fastening for selectively closing a front thereof, said inner jacket sewn to said outer gown, to cooperate therewith to form an upper opening, wherein said inner jacket is adapted to cover a desired portion of the patient.

BRIEF DESCRIPTION OF THE DRAWINGS

The above and other objects and advantages of the invention will become readily apparent to those skilled in the art from reading the following detailed description of the invention when considered in the light of the accompanying drawings, in which.

DETAILED DESCRIPTION OF THE PREFERRED EMBODIMENTS OF THE INVENTION

Figure 1:
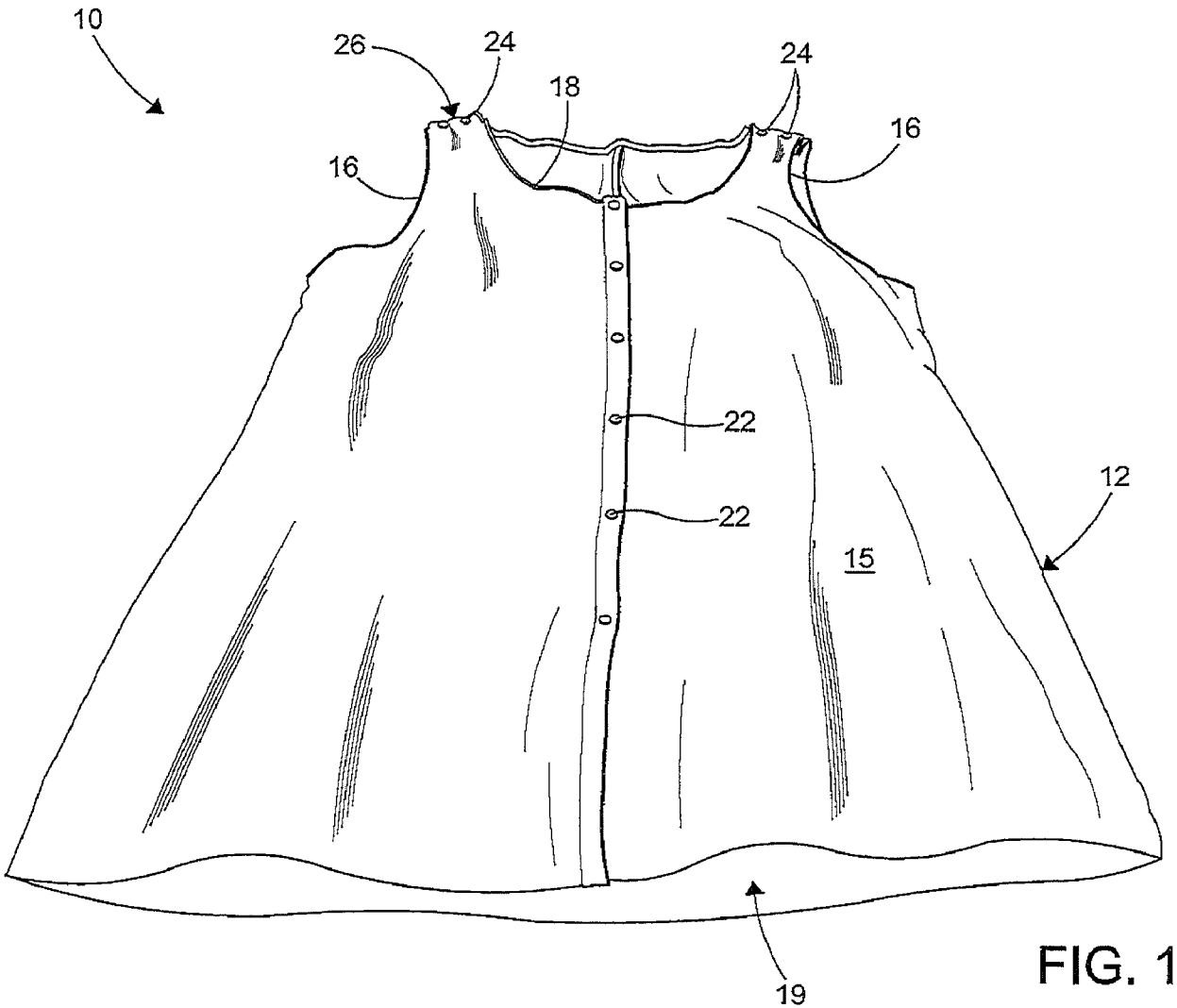
FIG. 1 is a front elevational view of a patient gown in accordance with an embodiment of the invention.

The following detailed description and appended drawings describe and illustrate an exemplary embodiment of the invention. The description and drawings serve to enable one skilled in the art to make and use the invention, and are not intended to limit the scope of the invention in any manner.

FIGS. 1-4 show a patient gown 10 including an outer gown 12 and an inner jacket 14 adapted to selectively cover the body and preserve the modesty of a patient when a desired portion of the body thereof is uncovered for examination, medical treatment, the nursing of a child, and the like. The patient gown 10 may be a sleeveless, three-quarter length gown having a body 15 with two arm openings 16, an upper opening 18, and a lower opening 19 formed therein. It is understood that the patient gown 10 may be short sleeved, long sleeved, or sleeveless, as desired. It is further understood that the patient gown 10 may comprise separate upper and lower portions, such as an outer shirt or sweatshirt having an inner jacket 14, and pants, shorts, or a skirt.

The outer gown 12 of the patient gown 10 typically includes a plurality of fasteners 22 on a front thereof and a plurality of fasteners 24 on an upper portion 26 thereof adjacent the upper opening 18. In the embodiment shown in FIGS. 1-4, the upper portion includes shoulder straps cooperating to form the upper opening 18. The fasteners 22 are adapted to selectively fasten the outer gown 12 in a closed configuration. The fasteners 24 cooperate with corresponding fasteners 25 to selectively open the outer gown 12 of the patient gown 10 to reveal a shoulder area thereof. In the illustrated embodiment, the fasteners 22, 24 are snaps; however, the fasteners 22, 24 may be one of a hook-and-loop fastener, magnets, zippers, buttons, pressure sensitive resealable adhesive, and the like, for example. Apertures may be formed in the body 15 of the outer gown 12 adjacent the upper opening 18, adjacent the lower opening 19, or adjacent the arm openings 16 to facilitate injections, insertion of catheters, insertion of IVs, examination, and the like, as desired. The outer gown 12 may also include a foley opening formed adjacent to where the patient's hip would be. The foley opening would be an approximately 6 inch vertical opening. A foley loop may be attached in a seam of the outer gown 12 adjacent to the foley opening. In a preferred embodiment, the outer gown 12 is formed from a cotton-polyester blend, but the outer gown 12 may be formed from cotton, polyester, rayon, silk, wool, a disposable fibrous or plastic material, or any conventional material suitable for clothing, as desired. It is further understood that the outer gown 12 may include pockets, as desired.

Figure 2:
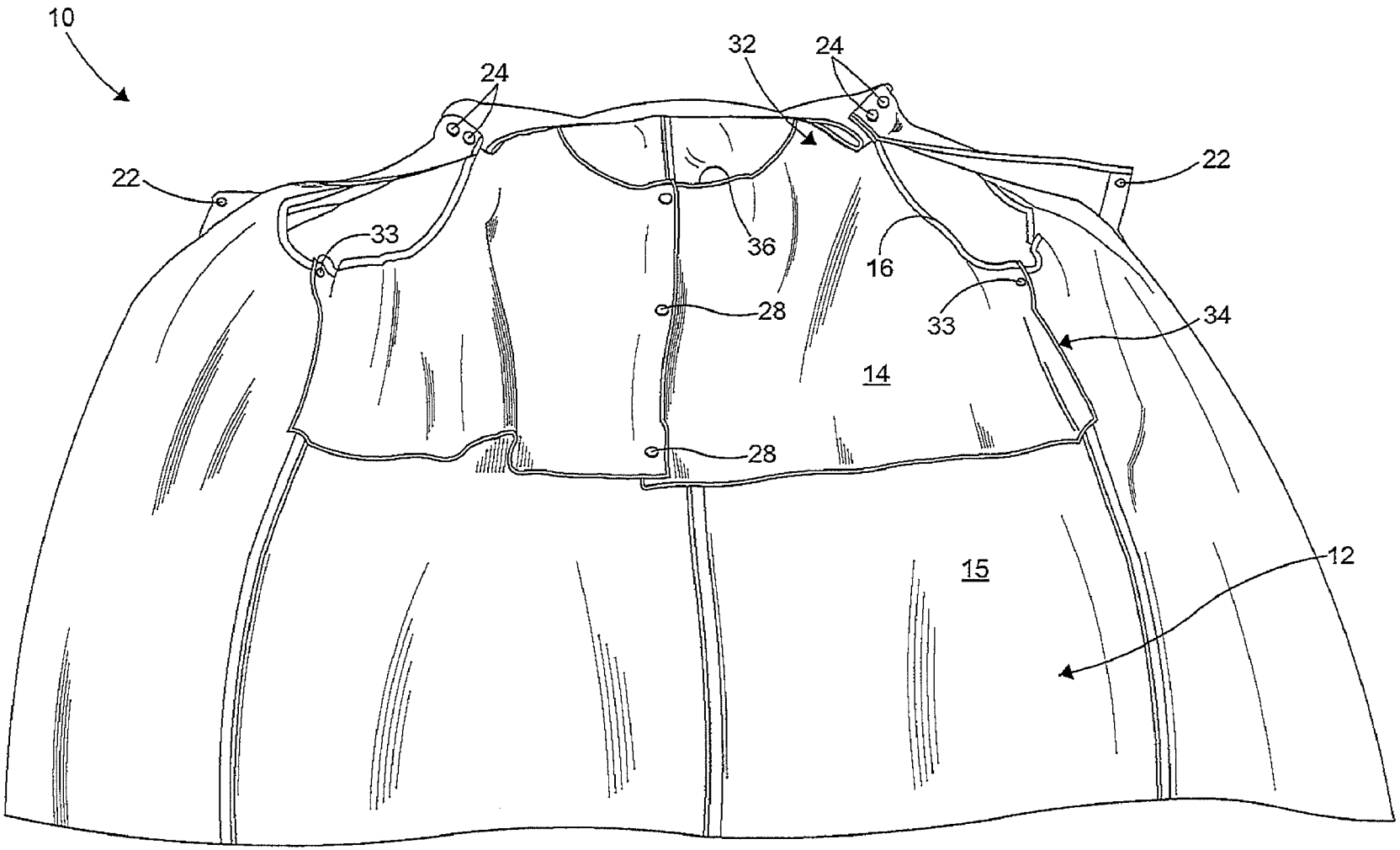
FIG. 2 is a front elevational view of the patient gown of FIG. 1 opened to reveal an inner jacket thereof.
Figure 3:
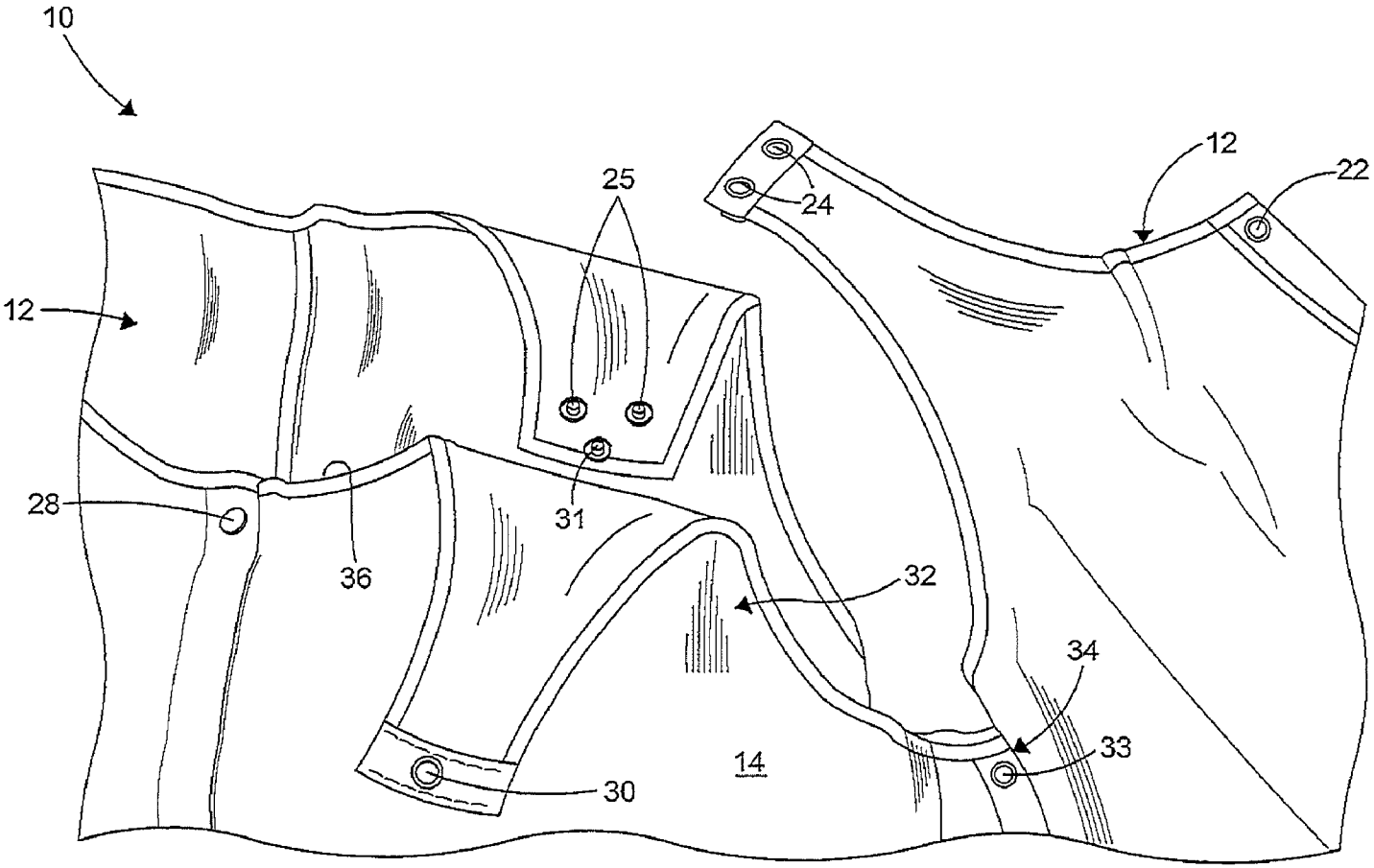
FIG. 3 is an enlarged fragmentary view of the patient gown and the inner jacket of FIG. 2.
Figure 4:
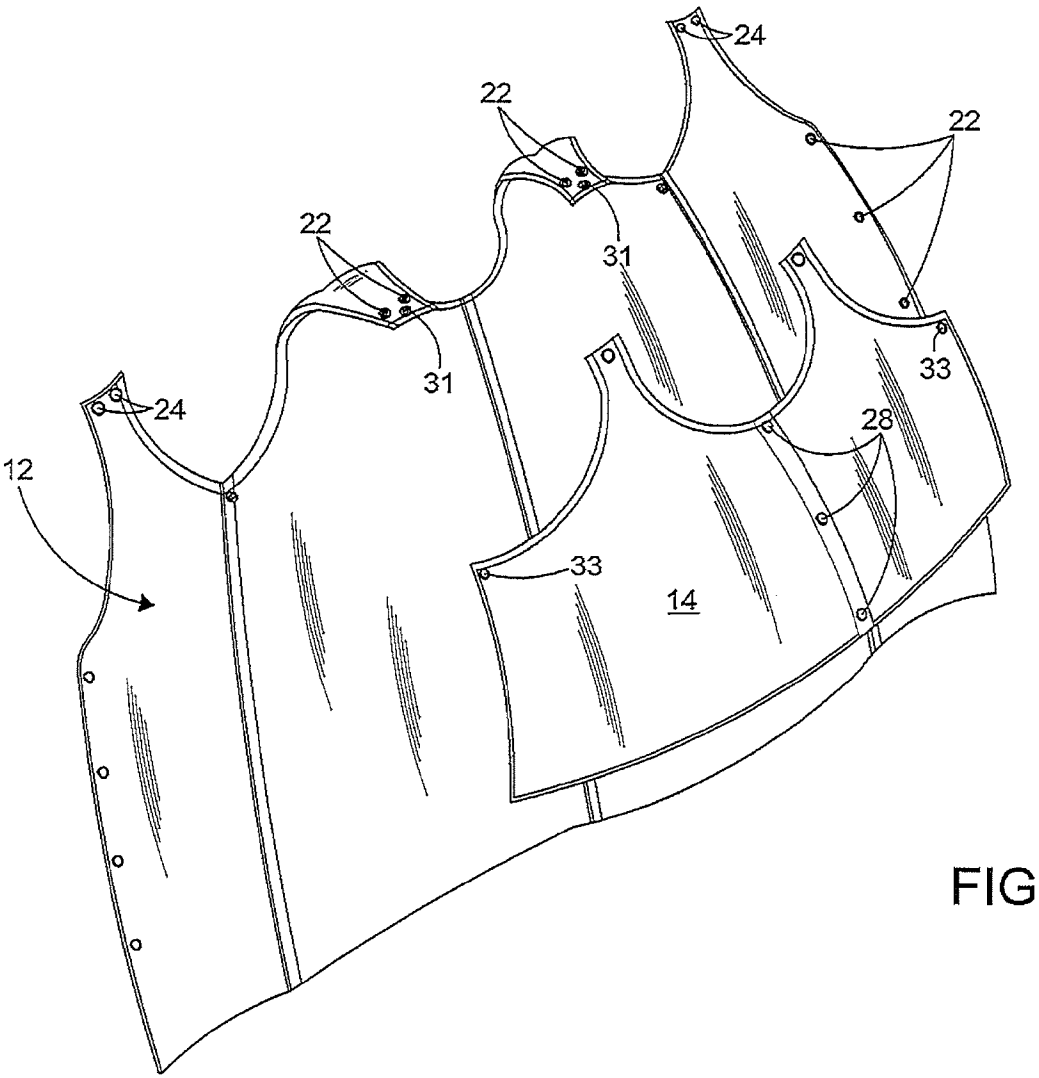
FIG. 4 is an exploded perspective view of the patient gown of FIG. 1 in an open position.
Figure 5:
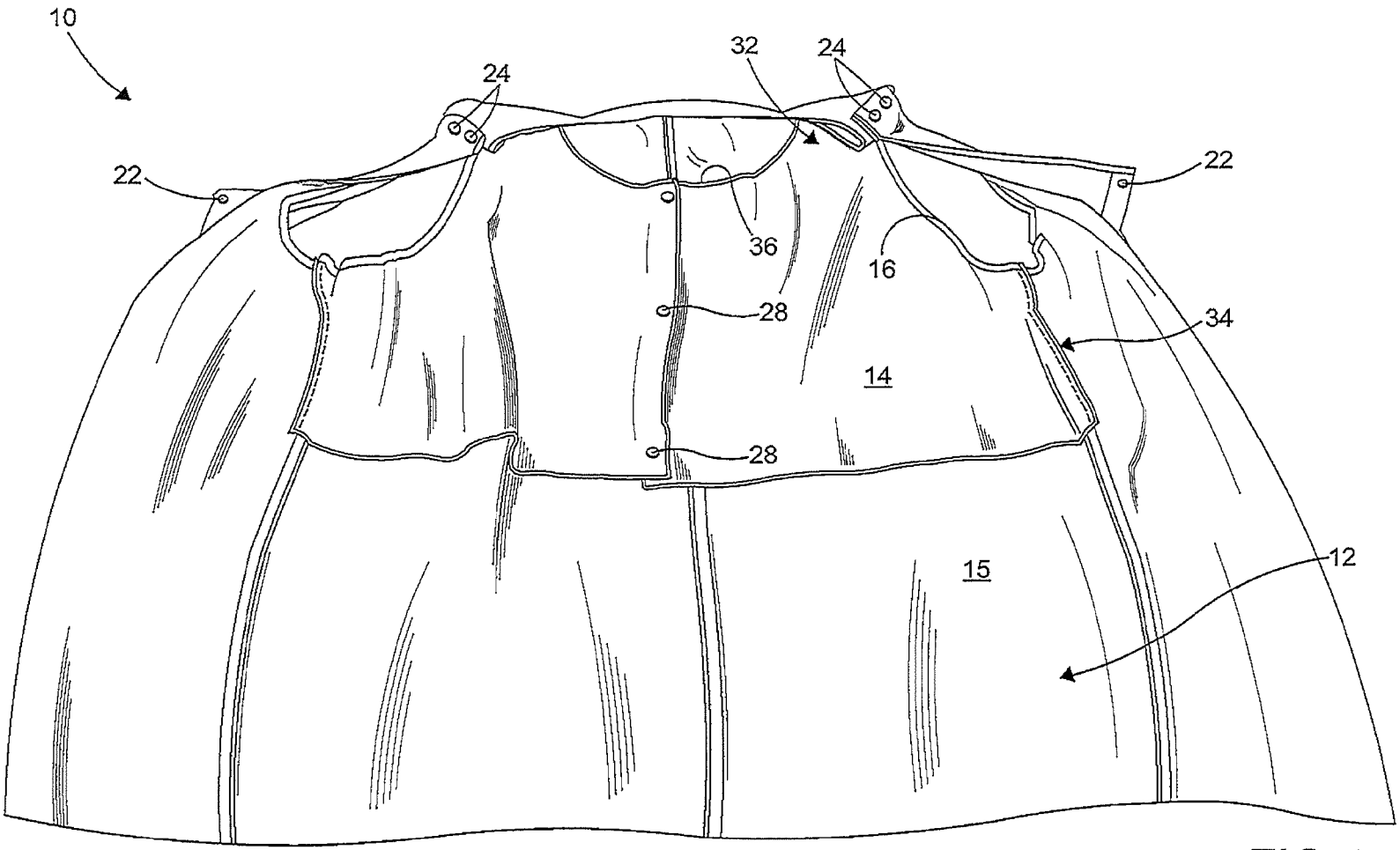
FIG. 5 is a front elevational view of a patient gown in accordance with another embodiment of the invention.

As shown in FIGS. 2 and 3, the inner jacket 14 of the patient gown 10 includes a plurality of fasteners 28 on a front thereof, a plurality of fasteners 30 on an upper portion 32 thereof, and a plurality of fasteners 33 on side portions 34 thereof. The fasteners 28 are adapted to selectively fasten the front of the inner jacket 14 in a closed position. The fasteners 30 fasten the upper portion 32 of the inner jacket 14 to the fasteners 31 of the upper portion 26 of the outer gown 12 of the patient gown 10 to form an upper opening 36 between the inner jacket 14 and the outer gown 12. It is understood that the fasteners 30 may fasten to seams sewn into the upper portion 26 of the outer gown 12. The fasteners 30 are adapted to selectively detach the upper portion 32 of the inner jacket 14 from the outer gown 12 to reveal a chest and shoulder area of the patient. The fasteners 33 fasten the side portions 34 of the inner jacket 14 to an interior of the outer gown 12 adjacent. The fasteners 33 are fastened to the outer gown 12 adjacent to the arm openings 16 formed therein. It is understood that the fasteners 33 may be disposed anywhere on the side portions 34 of the inner jacket 14, or the inner jacket 14 may be sewn into the interior of the outer gown 12, as shown in FIG. 5. The fasteners 33 are adapted for selectively removing the side portions 34 of the inner jacket 14 to reveal a breast or chest area of the patient. In the illustrated embodiment shown in FIG. 3, the fasteners 28, 30 are snaps; however, the fasteners 28, 30 may be one of a hook-and-loop fastener, magnets, zippers, buttons, pressure sensitive resealable adhesive, and the like, for example. Apertures may be formed in the inner jacket 14 to facilitate injections, insertion of catheters, insertion of IVs, and the like, as desired. In the embodiment shown, the inner jacket 14 is formed from a cotton-polyester blend, but the inner jacket 14 may be formed from cotton, polyester, rayon, silk, wool, a disposable fibrous or plastic material, or any conventional material suitable for clothing, as desired. It is further understood that the inner jacket 14 may include pockets, as desired.

In use, the patient gown 10 is worn by the patient with the fasteners 22 of the outer gown 12 and the fasteners 28 of the inner jacket 14 disposed on the front of the patient, thereby covering the backside of the patient to maintain the modesty thereof. Desired fasteners 22 of the outer gown 12 are selectively detached to reveal the inner jacket 14 of the patient gown 10. When the patient is nursing a child, the desired fasteners 28 of the inner jacket 14 are opened to reveal the breast of the patient. The child is then positioned to nurse from the breast, and a portion of the outer gown 12 may be draped over the child and the breast, thereby covering the child and breast to maintain privacy. It is understood that any of the fasteners 28, the fasteners 30, the fasteners 33, or a combination thereof, may be selectively detached to facilitate exposure of the breast for nursing of the child.

When a physician is required to examine the patient, or when a nurse is required to inject patient or insert a catheter or IV into the patient, the fasteners 22 of the outer gown 12 are selectively detached to reveal the inner jacket 14. The fasteners 28, 30, 33, are then selectively detached to facilitate exposure of the desired area of patient such as the breast, a shoulder, a portion of the chest, or the abdomen of the patient. Apertures may be formed in the body 15 of the outer gown 12 adjacent the upper opening 18, the lower opening, or the arm openings 16 to facilitate injections, insertion of catheters, insertion of IVs, and the like, without opening the patient gown 10.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A patient gown comprising:

an outer gown having a body portion with arm openings and an upper opening and a first means for fastening for selectively closing a front thereof, an upper portion of said outer gown having shoulder portions cooperating to form the upper opening of the outer gown; and an inner jacket including a second means for fastening for selectively closing a front thereof, said inner jacket releasably fastened to said outer gown, and an inner surface of an upper portion of said inner jacket releasably fastened to an outer surface of the shoulder portion of said outer gown, wherein said inner jacket is adapted to selectively cover a desired portion of the patient, and a third means for releasably fastening said inner jacket to said outer gown.

2. The patient gown of claim 1, wherein the first means for releasably fastening, the second means for releasably fastening, and the third means for releasably fastening are each one of hook-and-loop fasteners, magnets, zippers, buttons, snaps, a pressure-sensitive resealable adhesive, and a combination of the foregoing.

3. The patient gown of claim 1, wherein said outer gown and said inner jacket are formed from one of cotton, a polyester, a cotton-polyester blend, rayon, silk, a plastic, and wool.

4. The patient gown of claim 1, wherein said outer gown and said inner jacket are formed from a disposable fibrous material.

5. The patient gown of claim 1, wherein said outer gown and said inner jacket are formed from a disposable plastic material.

6. The patient gown of claim 1, wherein said inner jacket is releasably fastened to an interior of said outer gown.

7. The patient gown of claim 1, wherein said inner jacket is adapted to cover the upper body of the patient.

8. The patient gown of claim 1, wherein said inner jacket is adapted to cover a breast area of the patient.

9. The patient gown of claim 1, wherein said inner jacket is sewn into said outer gown.

* * * * *